US006381916B1

(12) United States Patent
Maisch et al.

(10) Patent No.: US 6,381,916 B1
(45) Date of Patent: May 7, 2002

(54) UPRIGHT CONSTRUCTION SECTION

(75) Inventors: Walter Maisch, Gaggenau; Jürgen Eckert, Sinzheim; Helmut Stern, Gaggenau; Theo Hertweck, Baden-Baden, all of (DE)

(73) Assignee: Profil-Vertrieb GmbH, Gaggenau (DE)

( * ) Notice: Subject to any disclaimer, the term of this patent is extended or adjusted under 35 U.S.C. 154(b) by 0 days.

(21) Appl. No.: 09/619,415

(22) Filed: Jul. 19, 2000

(30) Foreign Application Priority Data

Jul. 21, 1999 (DE) ..... 199 34 310

(51) Int. Cl.[7] ..... E04C 3/30

(52) U.S. Cl. ..... 52/736.1; 52/736.3; 52/738.1; 52/730.1; 52/481.1; 52/800.12; 52/716.8; 52/717.06

(58) Field of Search ..... 52/736.1, 736.3, 52/738.1, 730.1, 481.1, 800.12, 716.8, 717.06

(56) References Cited

U.S. PATENT DOCUMENTS

| | | | | | |
|---|---|---|---|---|---|
| 3,278,043 | A | * | 10/1966 | Kimpton | 211/148 |
| 4,011,704 | A | * | 3/1977 | O'Konski | 52/735 |
| 4,064,996 | A | * | 12/1977 | Shillum | 211/191 |
| D257,639 | S | * | 12/1980 | Reid et al. | D25/78 |
| 4,478,018 | A | * | 10/1984 | Holand | 52/220 |
| 5,555,689 | A | * | 9/1996 | Gilmore | 52/489.1 |
| 5,592,786 | A | * | 1/1997 | Kamm | 52/28 |
| 5,619,837 | A | * | 4/1997 | DiSanto | 52/798.1 |
| 5,749,192 | A | * | 5/1998 | Menchetti | 52/489.1 |
| 5,832,691 | A | * | 11/1998 | Callahan et al. | 52/737.3 |
| D439,680 | S | * | 3/2000 | Bennett | 52/92.3 |
| 6,205,740 | B1 | * | 3/2001 | Ekerholm et al. | 52/731.9 |

FOREIGN PATENT DOCUMENTS

| | | |
|---|---|---|
| AT | 302 606 | 9/1972 |
| DE | 28 17 879 | 10/1979 |
| DE | 36 19 398 | 7/1987 |
| EP | 0 136 618 | 4/1985 |
| FR | 2 766 905 | 2/1999 |
| GB | 646 370 | 11/1950 |
| GB | 1 068 761 | 5/1967 |

* cited by examiner

*Primary Examiner*—Carl D. Friedman
*Assistant Examiner*—Chi Nguyen
(74) *Attorney, Agent, or Firm*—Collard & Roe, P.C.

(57) ABSTRACT

An upright section having two section legs extending spaced from each other in the longitudinal direction of the section and connected with each other by a section bridge. The section bridge is equipped with at least one elastic segment having low transverse spring temper and extending in the longitudinal direction of the section. The elastic segment is shaped out of the plane put up by the section bridge and connects the section legs with bending elasticity. Since the section bridge is equipped with at least one elastic segment extending lengthwise, the upright section is divided in two section parts that are connected with each other only via the elastic segment arranged between the two parts.

12 Claims, 2 Drawing Sheets

UPRIGHT CONSTRUCTION SECTION

BACKGROUND OF THE INVENTION

1. Field of the Invention

The invention relates to an upright construction section having two section legs that extend spaced from each other in parallel positions and are connected with each other by a common section bridge. In particular, the invention concerns a C-shaped upright section with edge flanges extending along the longitudinal edges of the section legs opposite the bridge and pointing inwards.

2. The Prior Art

Upright sections of this type, and in particular C-shaped upright sections, are known in general and are primarily used in the field of dry construction, such as for building up lightweight partitions.

With such partitions, the section bridges of the upright sections are aligned perpendicular to the planes of the walls, and lightweight construction panels (or boards) are arranged on both sides and screwed to the legs of the section. Such lightweight partition wall panels may be gypsum cardboard panels, for example. Screws with self-cutting threads are used for fastening. In order to make it easier to drive in screws with self-cutting threads, the outer sides of the section legs are normally equipped with fish-skin profiles.

Partitions of this type, which are two-panel wall systems, must meet certain requirements regarding sound and fire protection. Multi-layered wall systems have already been proposed to that extent. As far as sound protection is concerned, the upright sections are the weak point in connection with such partition walls.

An upright section intended for building up two-board paneling systems is described in German Patent No. DE 36 19 398 C1, where the legs of the section are each flexibly connected with the section bridge over the longitudinal expanse of the section via a flexible section. The connection zones project from the section bridge facing away from the legs of the section, and consist of through-extending strips of hairpin springs. A stop means limits the elastic mobility of the section legs for yielding into the section cavity enclosed by the non-deformed upright section.

This known design is based on the documented finding that it is possible to reduce sound permeability through upright sections having a transverse spring temper.

This known upright section is used successfully; however, it is expensive to manufacture and it is deficient in sound protection. It is therefore an object of the present invention to provide an upright section that can be manufactured in a simple way and permits the construction of partition walls with reduced permeability to sound.

SUMMARY OF THE INVENTION

The present invention comprises a construction section having two upright legs spaced from each other and connected by a bridge. The section is C-shaped and has inwardly pointing edge flanges extending along the longitudinal edges of the section legs. The bridge of the section has at least one elastic segment with low transverse spring temper that extends in the longitudinal direction of the section. The elastic segment is shaped from the plane that is formed by the section bridge and provides a flexible connection to the section legs.

With the upright section as defined by the invention, the desired reduction in the transverse spring temper is obtained in that the section bridge is interrupted by at least one elastic segment extending lengthwise. The upright section consequently consists of two components that are not rigidly connected with one another, but via the elastic segments. The two components are movable against each other to a limited extent depending on the elasticity of the elastic segment.

It is therefore possible to build up two-board paneling systems with bending elasticity whose permeability to sound is noticeably reduced versus two-board paneling systems with upright sections as defined by the prior patents described above.

To reduce sound permeability, the side on which the elastic segment is shaped is unimportant. To connect the sections with brickwork walls, however, it is advantageous if the elastic segment protrudes into the interior of the section in the direction of the section legs.

Of course, the section bridge can be equipped with a plurality of elastic segments extending parallel with each other instead of using a lengthwise extending elastic segment. The elastic segments are preferably equally shaped.

If there is only one elastic segment, it should be arranged in about the center of the width of the section bridge, and preferably symmetrically in relation to a center line of the section bridge.

With the prior sections described above, the section legs are joined with the bridge with bending elasticity via connection zones designed as closed hairpin-like flexible sections. In the upright section as defined by the invention, the elastic segment is provided with perforations, slots or other recesses that are spaced from each other, so that components of the upright section extending on both sides of the elastic segment are accordingly joined with one another only via narrow material bridges.

It is particularly useful if the spaced-apart recesses of the elastic segment are shaped as slots extending in the longitudinal direction of the section, or if the slots of the elastic segment are arranged offset relative to one another.

According to a further development of the invention, the slots of the elastic segment are arranged in adjacent rows and within each row in such a way that there is space for the narrow material bridges. The slots arranged next to the slots that are successively arranged in the longitudinal direction extend across the material bridges formed between the slots arranged lengthwise. According to another development of the invention, all of the slots of the elastic segment have the same lengths and widths.

According to another important further development of the invention, the slots of the springy segment are not punched, but rather stamped through, with the edges of the slot set upright toward one side. The stamped-through slots usefully project into the interior of the section. Such through-stamped slots can be produced with suitable rolling tools.

The interruption of the section bridge by an elastic segment with low transverse spring temper and extending in the longitudinal direction of the section naturally results in the section legs yielding against each other as self-cutting screws are driven in for mounting lightweight construction panels, which logically makes it more difficult to panel the upright sections.

In order to remedy this problem, supporting elements are received between the legs of the section, which prevent the legs from being pressed together. Such supporting elements are preferably insulation material elements that are substantially dimensionally stable. Such elements may consist of a material such as rock wool, and are received in the interior of the section. The use of rock wool leads to improved fire protection for the partition walls so constructed.

When enhanced fire protection is unimportant, it is possible to injection mold insulating material into the interior of the section. Polyurethane foams, for example, can be considered for this purpose. If such supporting elements extend over the length of the upright sections, the sections are also provided with enhanced longitudinal stiffness, which is entirely desirable for reasons of stability.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
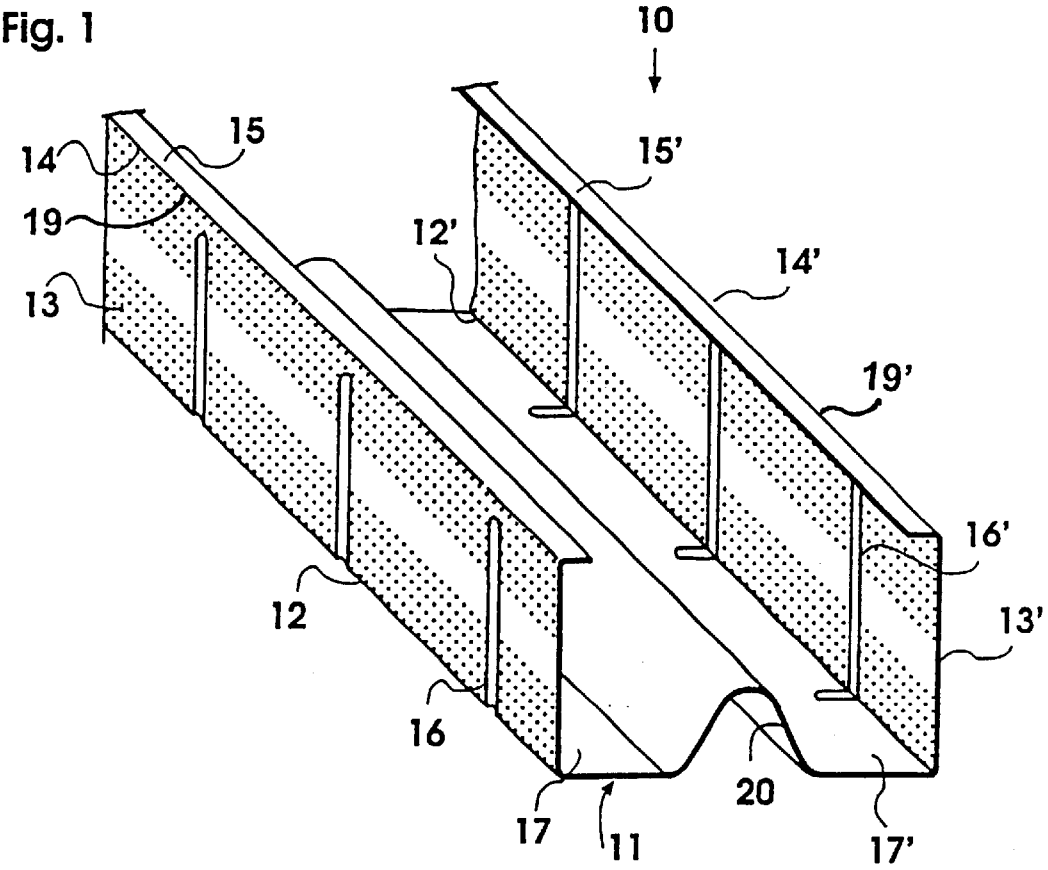
FIG. 1 is a perspective view of a longitudinal part of a C-shaped upright section with an elastic segment shaped into the interior of the section from the plane of the bridge.

Referring now in detail to the drawings, FIG. 1 shows an upright section 10, which is a C-section that has a section bridge 11 and two section legs 13, 13' extending in parallel positions and spaced from each other. The section legs are bent off from the section bridge 11 along the bending edges 12, 12'. On the longitudinal edges 19, 19' of the section legs 13, 13' that are removed from the section bridge 11, bent-off edge flanges 15, 15' extend along the bending edges 14, 14' inwards and in parallel positions relative to the section bridge 11.

Transversely to the longitudinal direction of the section, reinforcing beads 16 are stamped in with pre-determined spacings from each other in the outside section legs 13, 13' in a known manner with fish skin profiles. This makes it easier to drive in screws with self-cutting threads.

The reinforcing beads extend across the bending edges 12, 12' up into the adjoining edge zones 17, 17' of the section bridge 11. As an alternative, it is possible to stamp in reinforcing beads that only reach over the bending edge 12, 12' and up to the edge zones 17, 17' bordering the section bridge 11 and the section legs 13, 13'.

Figure 2:
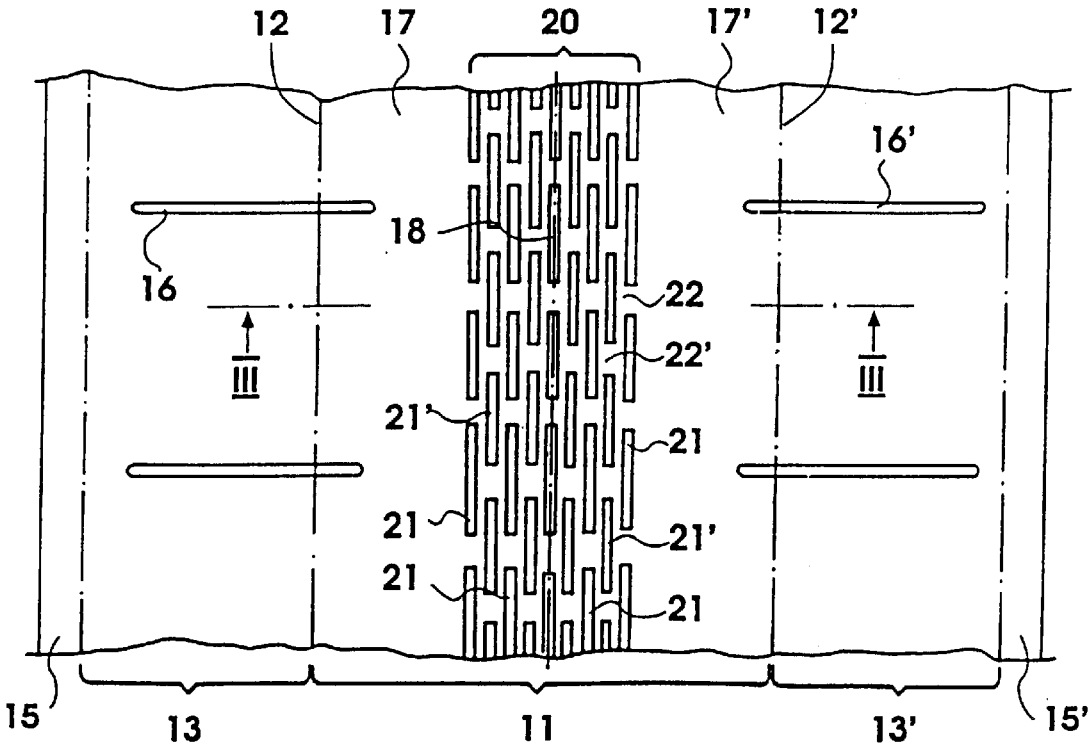
FIG. 2 is a top view of the upright section with indicated bending edges between the legs and the bridge of the section, as well as with slots stamped through in adjacent rows, with the slots extending in the longitudinal direction of the section and arranged offset in relation to each other.

The center of the section bridge 11 is equipped with an elastic segment 20 designed symmetrically relative to a center line 18 and being shaped upwards from the plane of the section bridge 11 into the interior of the section 10. The lengthwise extending elastic segment 20 consists of longitudinal slots 21, 21' that are punched through and spaced from each other in parallel rows. The stamped slots 21, 21' arranged in adjacent rows and offset relative to each other so that the slots 21 of one row each extend beyond the material bridges between the longitudinal slots 21' in an adjacent row. This is shown by the layout of the upright section 10 shown in FIG. 2.

Figure 3:
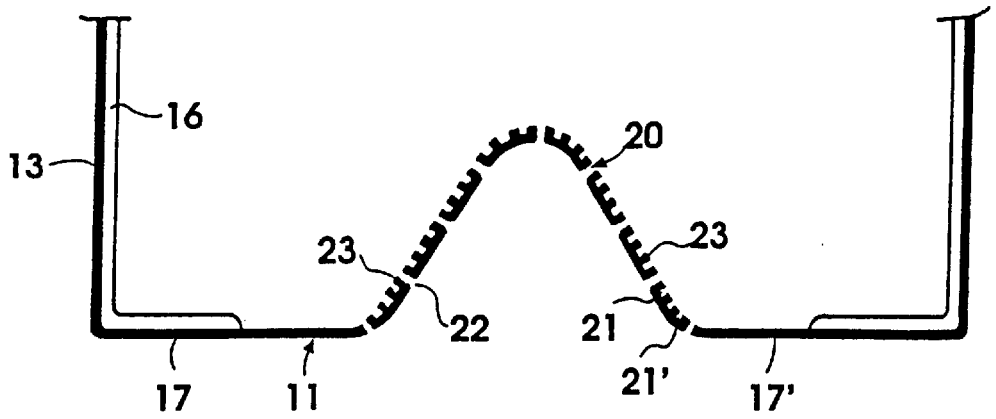
FIG. 3 is a cross sectional view through the upright section corresponding with the section line III—III in FIG. 2.

The longitudinal punched slots 21, 21' of the elastic segment 20 are punched through and limited by the slot edges 23 projecting into the interior of the section. This is shown in FIG. 3.

Figure 4:
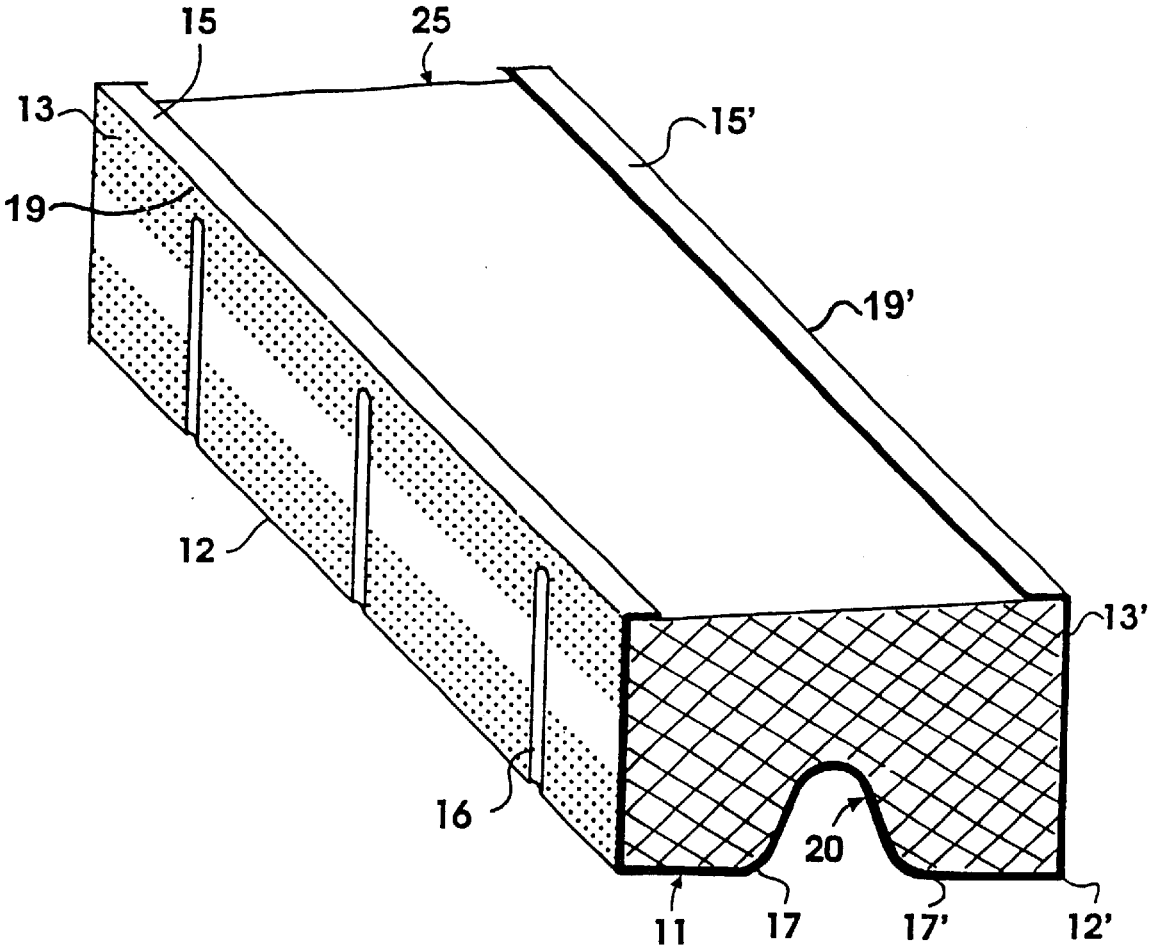
FIG. 4 shows a perspective view of an upright section with an insulating element received in its cavity.

In the embodiment shown in FIG. 4, a substantially dimensionally stable insulating material element 25, which serves as a supporting element and which made of rock wool is received the section legs 13, 13' and between the section bridge 11 and the edge flanges 15, 15'. This insulating material element supports section legs 13, 13', which project parallel with one another on the non-deformed upright section 10, so that when self-cutting screws are driven in, the section legs are prevented from yielding inwards as a result of the forces acting on the section legs 13, 13' from the outside. In addition to a support function, the dimensionally stable insulating material element 25 also provides for improved protection against fire and enhanced longitudinal rigidity of the entire section.

Accordingly, while only a few embodiments of the present invention have been shown and described, it is obvious that many changes and modifications may be made thereunto without departing from the spirit and scope of the invention.

What is claimed is:

1. An upright construction section for building partition walls, comprising:

two parallel section legs each having two longitudinal edges and extending spaced apart from each other, each section leg having a longitudinal inwardly pointing edge flange extending along one of said longitudinal edges;

a common section bridge connecting said section legs a long said longitudinal edges, opposite from said edge flanges, said bridge having at least one elastic segment having low transverse spring temper extending in a longitudinal direction of the section, wherein said at least one elastic segment is shaped from a plane formed by said section bridge and provides a flexible connection between said section legs, wherein said at least one elastic segment has a plurality of recesses spaced apart from each other, wherein said recesses are slots extending in the longitudinal direction of the section.

2. The upright section according to claim 1, wherein said elastic segment is shaped to extend toward said section legs.

3. The upright section according to claim 1, wherein said elastic segment is arranged in a center of the width of said section bridge.

4. The upright section according to claim 3, wherein said elastic segment is symmetric in relation to a center line of said section bridge.

5. The upright section according to claim 1, wherein said slots are arranged offset in relation to each other.

6. The upright section according to claim 1, wherein said slots are arranged in adjacent rows, with narrow material bridges being left within each row between said slots.

7. The upright section according to claim 1, wherein said slots all have the same lengths and widths.

8. The upright section according to claim 1, wherein said slots are stamped through and have slot edges set upright toward one side.

9. The upright section according to claim 8, wherein said upright slot edges protrude into an interior portion of said upright section.

10. The upright section according to claim 1, further comprising at least one supporting element disposed between said section legs, said at least one supporting element supporting said legs against compression.

11. The upright section according to claim 10, wherein said at least one supporting element is a substantially dimensionally stable insulating material element disposed in an interior of said upright section.

12. The upright section according to claim 11, wherein said supporting element is made of rock wool.

* * * * *